US005194077A

United States Patent [19]

Bargiel et al.

[11] Patent Number: 5,194,077

[45] Date of Patent: Mar. 16, 1993

[54] DUAL CHAMBER FILTER ASSEMBLY WITH SHAKER

[75] Inventors: Douglas A. Bargiel, Bowling Green; Jack L. Burgoon, Toledo; Anthony P. DiGiovanni, Maumee; Norbert H. Himburg, Milton Center, all of Ohio

[73] Assignee: Clarke Industries, Inc., Bowling Green, Ohio

[21] Appl. No.: 779,905

[22] Filed: Oct. 21, 1991

Related U.S. Application Data

[63] Continuation of Ser. No. 496,229, Mar. 20, 1990, abandoned.

[51] Int. Cl.[5] ..... B01D 46/04

[52] U.S. Cl. ..... 55/300; 55/304; 15/352

[58] Field of Search ..... 15/347, 549, 352; 55/300, 304

[56] References Cited

U.S. PATENT DOCUMENTS

| | | | |
|---|---|---|---|
| 3,304,572 | 2/1967 | Wendel | 15/352 |
| 3,892,008 | 7/1975 | Christensen et al. | 15/347 X |
| 4,258,451 | 3/1981 | Sommerfeld | 55/300 X |
| 4,328,014 | 5/1982 | Burgoon et al. | 55/300 |
| 4,345,353 | 8/1982 | Sommerfeld | 15/349 |
| 4,502,874 | 3/1985 | Levil et al. | 55/300 X |
| 4,514,875 | 5/1985 | Comer | 15/349 |
| 4,650,504 | 3/1987 | Howeth | 15/347 X |
| 5,013,333 | 5/1991 | Beaufoy et al. | 55/21 |

*Primary Examiner*—Charles Hart
*Attorney, Agent, or Firm*—Marshall & Melhorn

[57] ABSTRACT

A sweeper hopper and associated filter assembly as illustrated and described. The filter assembly effectively divides the hopper into a particulate contaminant receiving chamber and a clean air exhaust chamber. The filter assembly includes at least a pair of particulate blocking filter means and means for selectively directing the transient air stream through one or the other or both of the filter means. The filter assembly further includes cleaning means for selectively imparting the filter means, typically during periods of quiescence, to physically loosen and remove particulate contaminants therefrom and direct such contaminants into the contaminant receiving chamber.

9 Claims, 3 Drawing Sheets

DUAL CHAMBER FILTER ASSEMBLY WITH SHAKER

BACKGROUND OF THE INVENTION

This application is a continuation of application Ser. No. 07/496,229 filed on Mar. 20, 1990 and now abandoned.

1. Field of the Invention

Sweeper hopper and filter assemblies are typically utilized in riding type sweepers. Such sweepers include a hopper having a dirt and debris receiving chamber provided with an inlet opening for receiving dirt and debris directed therethrough by a rotating sweeper broom. The hopper is further provided with an exhaust chamber communicating with an exhaust blower for effectively establishing an air flow through the inlet opening, the dirt and debris receiving chamber, and the exhaust chamber. A filter assembly is employed to separate the two chambers and is effective to trap the transient particulate contaminants and allow clean air to flow therethrough to the exhaust chamber.

2. Description of Related Art

U.S. Pat. No. 4,328,014 to J. L. Burgoon et al discloses such a system and more specifically illustrates and describes a filter cleaning mechanism for periodically physically shaking the filter to cause contaminants collected thereon to be dislodged and fall into an associated dust contaminant receiving chamber. Manifestly, the contaminant dislodgement is most effectively achieved during a period when the sweeper is stopped and exhaust blower is deenergized. Obviously, the amount of down-time of the sweeper is a function of the type and volume of contaminant to which the sweeper is exposed.

U.S. Pat. No. 4,345,353 to G. L. Sommerfield discloses a sweeping machine and a striking mechanism for removing collected dust from an associated pleated filter disposed in the air stream between the inlet and the clean air outlet. The apparatus would function must efficiently during a period when the sweeper and associated exhaust blower mechanism is deenergized.

SUMMARY OF THE INVENTION

An object of the invention is to produce a sweeper hopper and filter assembly capable of handling a wide variety of dirt and debris and to minimize the downtime required to maintain optimum air filtering efficiency.

The objectives of the invention are typically achieved by a sweeper hopper and filter assembly comprising a main housing defining a hopper, the housing including a particulate contaminant inlet, a clean air outlet, conduit means providing communication between the inlet and the outlet, and means for maintaining a decreased pressure at the outlet compared to the pressure at the inlet; and a filter assembly disposed within the conduit means providing communication between the inlet and outlet of the housing, the filter assembly including filter media for militating against the flow of particulate contaminants therethrough and means to selectively block one portion of the filter media to prevent communication between the inlet and outlet of the housing through the blocked portion of the filter media, and means to dislodge particulate contaminants from the blocked portion of the filter media.

BRIEF DESCRIPTION OF THE DRAWINGS

Other objects and advantages of the invention will become manifest to one skilled in the art by reading the following detailed description of an embodiment of the invention when considered in the light of the accompanying drawings, in which.

DETAILED DESCRIPTION OF THE PREFERRED EMBODIMENT

Figure 1:
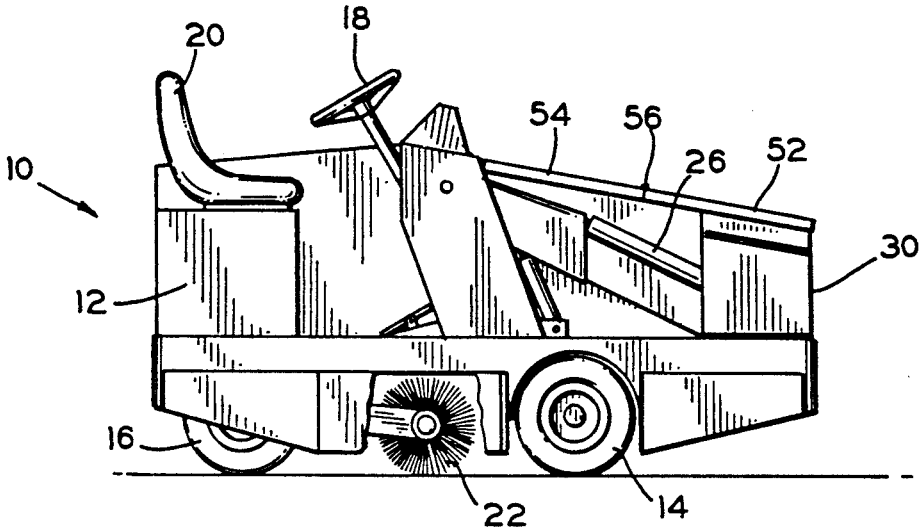
FIG. 1 is a schematic side elevational view of a riding sweeper embodying the present invention.
Figure 2:
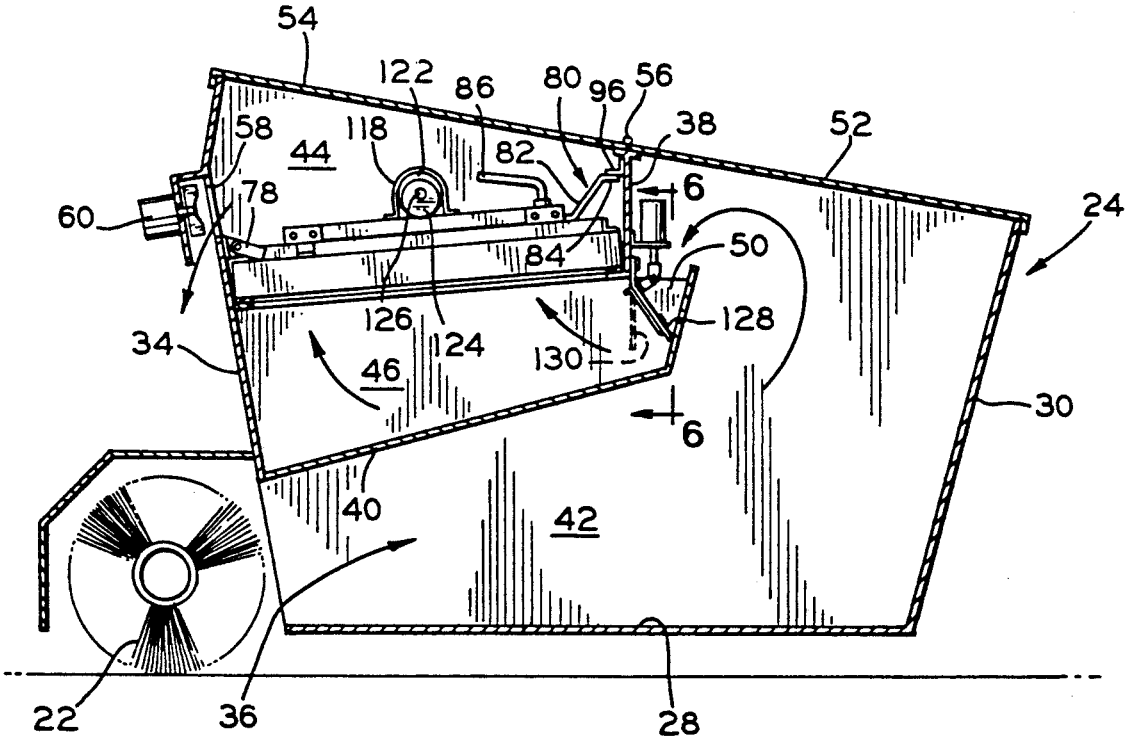
FIG. 2 is an enlarged fragmentary sectional view of the hopper and associated filter assembly of the sweeper illustrated in FIG. 1.

Referring to the accompanying drawings wherein like reference numerals are employed to designate similar parts throughout, there is illustrated in FIG. 1 a riding power driver sweeper, generally indicated by reference numeral 10, embodying the features of the invention.

The sweeper 10 includes a main body portion 12 supported by ground engaging front wheels 14, and a rearwardly disposed and centrally located wheel 16 which may be moved about a suitable pivot axis by an associated steering wheel 18 to effectively steer the sweeper 10. An operator's seat 20 is typically positioned immediately to the rear of the steering wheel 18.

A main rotary drum-type broom 22 is disposed rearwardly of the front wheels 14 and is typically power driven by suitable power take-off means from the motive force imparting engine of the sweeper as is well known in the art. Typically, the broom 22 is of sufficient length to be coextensive with the inlet opening of the associated hopper as will be explained hereinafter.

A hopper 24 is disposed at the forward portion of the sweeper 10 and may be pivotally mounted to the main body portion 12 by suitable pivot means (not shown). Such pivotal mounting enables the hopper 24 to be pivoted about the pivot axis by any suitable means, such as for example, pressure fluid actuating means 26 to effect dumping of debris and contaminants therefrom. The hopper 24 includes a bottom wall 28, upstanding front, side, and rear walls 30, 32 and 34, respectively. Typically, the rear wall 34 is provided with an inlet opening 36 through which debris picked up by the rotating broom 22 may enter into the interior of the hopper 24.

Further, the hopper 24 includes an intermediate wall 38 which is adapted to extend between the spaced apart side walls 32 and extends downwardly from the upper terminal edge of the side walls 32. A cooperating dividing wall 40 extends forwardly and upwardly of the inlet opening 36 and terminates in an upwardly extending wall. Both of the walls 38 and 40 span the entire distance between the facing interior surfaces of the side walls 32 and function to effectively define a debris chamber 42 and an exhaust chamber 44. The lower portion of the exhaust chamber 44 is divided into two separate dust chambers 46 and 48 by a vertically disposed dividing wall 50.

The hopper 24 is provided with top having a front section 52 which forms the top of the debris chamber 42 and a rear section 54 which forms the top of the exhaust chamber 44. The rear of the front section 52 and the front of the rear section 54 are respectively hingedly mounted by suitable hinge means, generally indicated by reference numeral 56, to the upper edge portion of the intermediate wall 38.

The rear wall 34 is provided with an outlet opening 58 which establishes communication with the exhaust chamber 44 and a vacuum blower 60. The blower 60 is effective to vacuumize the hopper 24 and cause a flow of air through the inlet 36, the chamber 42, and the exhaust chamber 44 and the associated dust chambers 46 and 48, the exhaust chamber 44, and the outlet opening 58, which vents to atmosphere.

A filter system is provided to filter the transient air and remove particular contaminants from the air stream. More specifically, the filter system includes two separate filtering units A and B and each unit is substantially identical with the other. Accordingly, only a single unit will be explained in detail and prime numerals will be used in respect of the second unit to simplify the explanation and resultant understanding of the structure.

Figure 4:
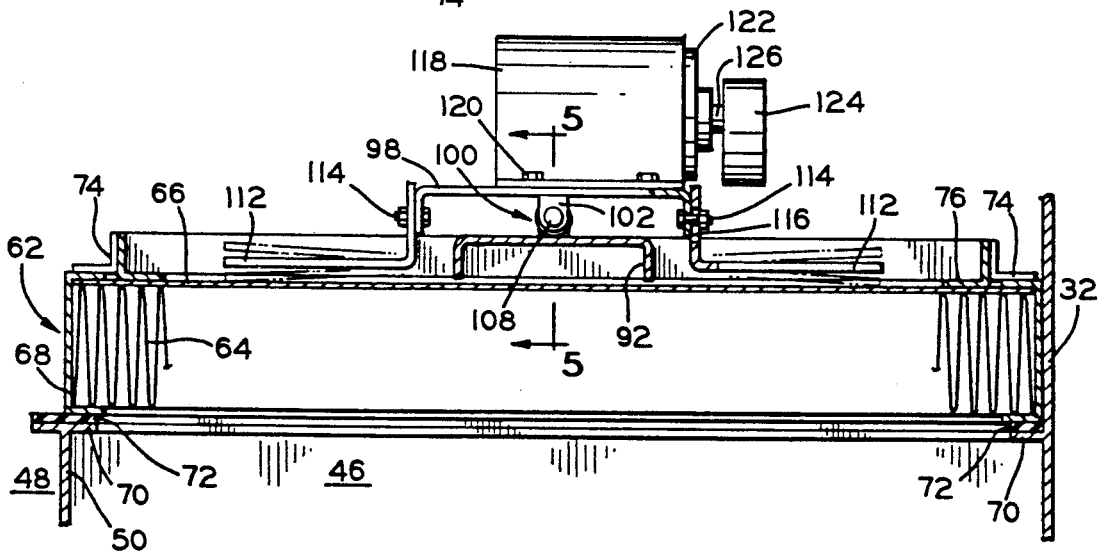
FIG. 4 is an enlarged sectional view taken along line 4—4 of FIG. 3 illustrating one filter element and an associated filter element shaker assembly.

The filtering unit A includes a filter element 62 having a pleated paper-type core 64, an expanded metal screen 66 and a metal frame 68, clearly illustrated in section in FIG. 4. The upstream surface of the filter element 62 faces the dust chamber 46, while the downstream surface faces the exhaust chamber 44. One side of the peripheral marginal edge of the filter frame 68 is supported on an inwardly extending flange 70 and associated gasket means 72. The opposite side of the peripheral marginal edge of the frame 68 is firmly held by a plurality of bracket members 74 which extend outwardly of a frame 76. The frame 76 is hingedly mounted to the inner surface of the rear wall 34 by suitable hinge means 78.

Figure 3:
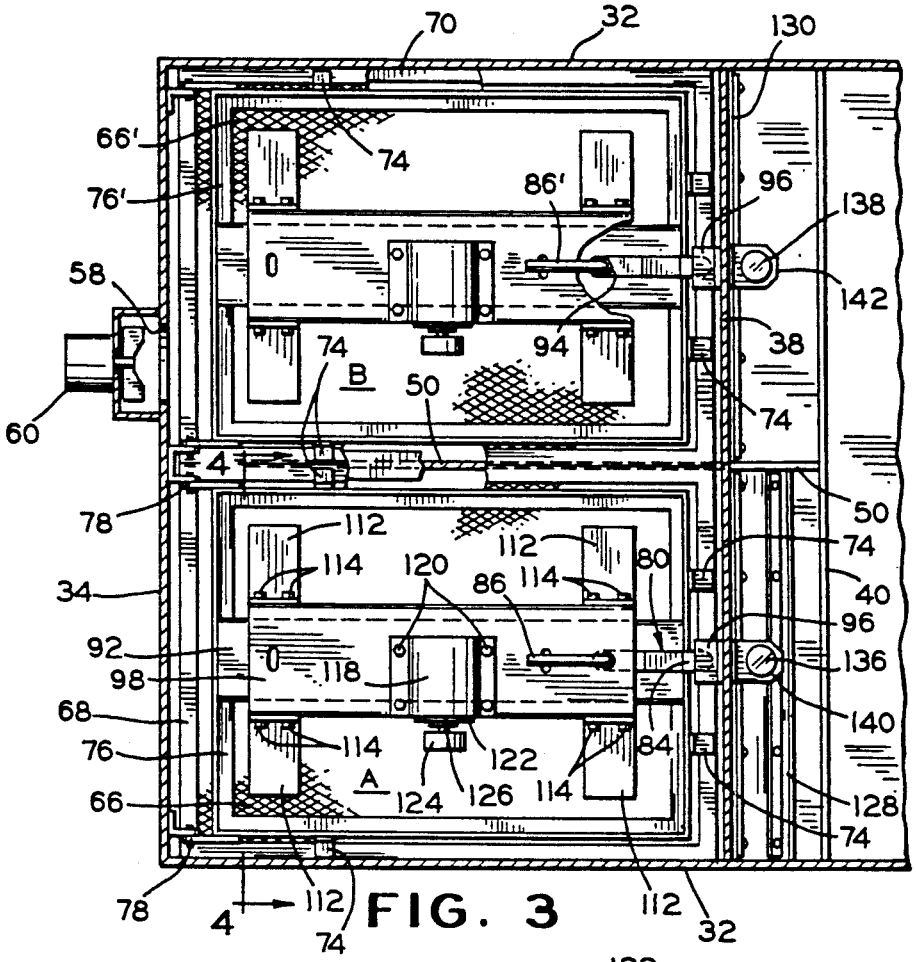
FIG. 3 is a fragmentary top plan view of the filter assembly illustrated in FIG. 2 with portions cut-away to more clearly illustrate the structure.

The frame 76 and the associated bracket member 74 are suitably locked in place by a latch mechanism 80 having a main portion 82 and an upper angular end portion 84. The lower end of the main portion 82 of the latch mechanism 80 has an aperture for receiving an L-shaped handle 86. The L-shaped handle 86 is provided with an externally threaded end 88 to be threadably received in a nut 90 affixed, as by welding for example, to a rocker mounting base 92. An associated upper nut 94 is threaded on an upper portion of the threaded end 88 of the handle 86 and is adapted to turn with the handle 86. When the handle 86 is turned in a counter-clockwise direction, as viewed in FIG. 3, the nut 94 firmly engages the portion 82 of the latch 80 and holds it in place with the upper end 84 disposed adjacent the lower surface of a flange member 96 secured to the upper edge portion of the intermediate wall 38. This provides ample force to hold the holding frame 76 against the filter element frame 68. When the handle 86 is turned in an opposite direction, the nut 94 moves with it and away from the latch portion 82, thereby permitting the latch 80 to be swung out to the side to simultaneously move the end portion 84 from the underside of the flange 96. It will be understood that the nut 94 may be replaced by a washer, for example, which could be formed integral with the handle 86.

Further, it will be readily apparent that the frame 76 is securely held against the filter element frame 68 during the operation of the overall system, and may be readily movable by swinging the latch 80 to the side and moving the frame 76 about the hinges 78 to provide access to the filter element 62 for service and replacement when necessary.

The rocker mounting base 92 is mounted on the filter holding frame 76 and typically spans the entire length of the frame 76. The opposing ends of the rocker mounting base 92 and integrally secured to respective portions of the frame 76 as welding, for example.

Figure 5:
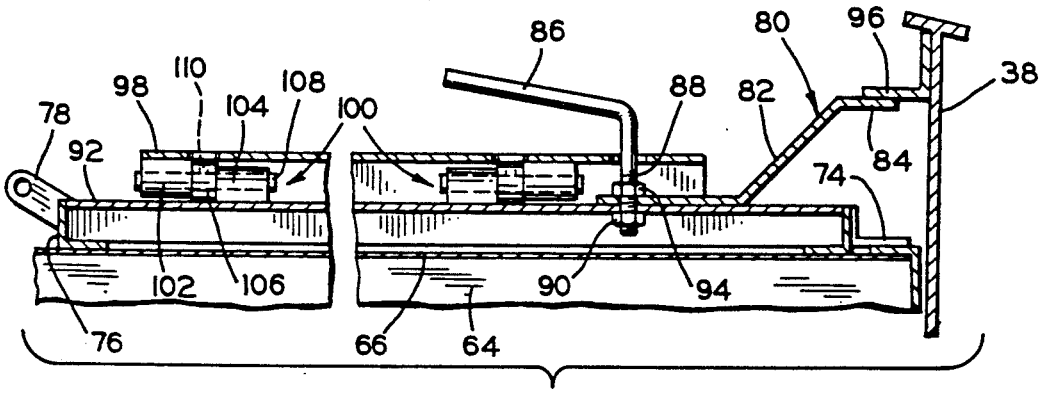
FIG. 5 is a sectional view taken along line 5—5 of FIG. 4 with the shaker motor broken-away to illustrate the pivotal mounting of the plate for supporting the motor and associated plate pads for impacting the filter element.
Figure 6:
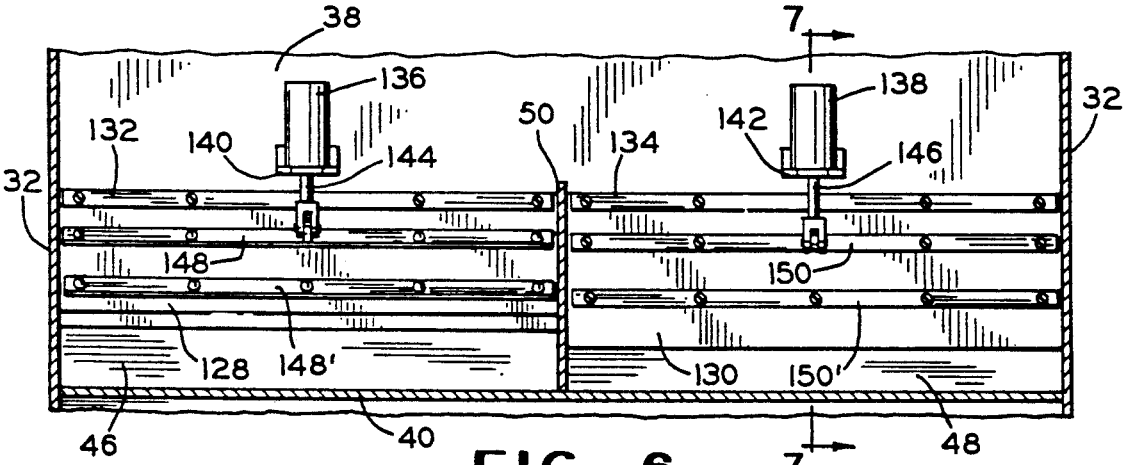
FIG. 6 is an enlarged fragmentary sectional view taken along line 6—6 of FIG. 2 illustrating the selectably operable air control doors for directing air flow through one or the other or both of the filter elements illustrated in FIG. 3.

A rocker plate 98 is pivotally mounted on the rocker mounting base 92 by means of a pair of spaced apart pivot assemblies 100, each of which includes a hollow sleeve 102 mounted to depend from the underside of the rocker plate 98, a hollow sleeve 104 mounted to project upwardly from the upper surface of the rocker mounting base 92, a hollow collar 106, and a pivot pin or rod 108. As clearly illustrated in FIG. 5, the collar 106 is provided with a set screw 110 adapted to firmly secure the pivot pin 108 and thereby enable the rocker plate 98 to pivot about the axis of the pivot pins 108 and relative to rocker mounting base 92.

Laterally extending rocker plate pads 112 are affixed to opposing sides of the rocke. plate 98 by suitable threaded fasteners 114. Vertical adjustment of the pads 112 with respect to the rocker plate 98 is achieved by forming elongate slots 116 in each of the pads 112. Relative positioning of the pads 112 is effected by loosening the respective threaded fasteners 114, adjusting the pad 112, and thence tightening the fasteners 114 after the desired adjustment has been made. It will be noted that the pads 112 may be adjusted vertically with respect to the rocker plate 98, but also may be rocked generally about the axis or axes of the fasteners 114 to effect the desired positioning of the pads 112 relative to the surface of the metal screen 66 of the filter element 62.

The mounting bracket 118 of generally semi-circular configuration is affixed to a central portion of the rocker plate 98 by suitable fasteners 120. The bracket 118 securely holds an electric motor 122 to the rocker plate 98. An eccentric weight 124 is affixed to a drive shaft 126 of the motor 122 and is effective to shake the motor 122 and the rocker plate 98 about the pivot pins 108 when the driveshaft 126 and the associated eccentric weight 124 are rotated.

Upon energization of the motor 122, the assemblage noted above is rocked about the pivot pin 108 causing the associated pads 112 to alternately strike or contact the expanded metal screen 66 of the filter element 62. This action causes particulate contaminants collected by the pleated paper core 64 to be dislodged therefrom and fall downwardly through the dust chamber 46 and onto the upper surface of the dividing wall 40.

Figure 7:
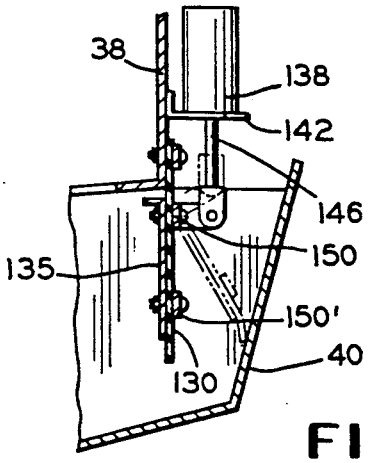
FIG. 7 is a fragmentary sectional view taken along line 7—7 of FIG. 6 illustrating an air control door and associated control mechanism.

The filter assembly also includes means for effectively selectively blocking air flow through one or the other of the filtering units A or B and its associated filter element 62 or 62', respectively. More specifically, elongate doors 128 and 130 formed of elastomeric sheet material, for example, are secured to the intermediate wall 38 by closure strips 132 and 134, respectively. The closure strips 132 and 134 are secured to the intermediate wall 38 by any suitable fastening means, such as threaded fasteners, for example. The lower depending portion of the doors 128 and 130 are provided with suitable backing plates 135 which may be substantially coterminous with the respective one of the doors 128 and 130. When the doors 128 and 130 are moved upwardly, the lower ends thereof are designed to contact the inner surface of the upwardly extending portion of the dividing wall 40, as is clearly illustrated in phantom lines in FIG. 7. The upper most edges of the backing plates 135 may be provided with a flange extending generally normal to the plane of the plates 135. The purpose of such a construction is to supplement the inherent structural rigidity of the material used in fabricating the plates 135.

The plates 135 are secured to the closure doors 128 and 130, by spaced pairs of substantially rigid strips 148, 148', and 150, 150', respectively. Threaded fasteners, as illustrated, may be employed to suitably secure the strips 148, 148', 150, 150' to the appropriate backing plate 135. In typical embodiments, the closure doors 128 and 130 are effectively sandwiched between the backing plates 135 and the rigidizing strips 148, 148', 150, and 150'.

Electrically actuated solenoid motors 136 and 138 are mounted on the intermediate wall 38 by suitable brackets 140 and 142, respectively. Reciprocatively moveable solenoid drive shafts 144 and 146 depend from the solenoid motors 136 and 138, respectively, and are adapted to have their distal end portions pivotally connected to the strips 148 and 150, respectively.

It will be noted that the portion of the sheet material of the closure doors 128 and 130 between the closure strips 132, 134 and the lifting strips 148 and 150, respectively, function as a living hinge as will be manifest from the description of the operation of the invention to follow.

It is considered that the ideal energization of the closure doors 128 and 130 would involve the opening and closing thereof in a sequence to assure a continuous flow of air to be treated through at least one of the filter elements 62 and 62' at all times.

It would be understood that when one of the closure doors 128 or 130 is caused to be closed and thereby cut-off the flow of air therethrough, the electrical circuitry would simultaneously energize the respective electric motor 122 or 122'. For example, simultaneously with the movement of the closure door 128 to a closed position, as illustrated clearly in FIG. 7, the air flow through the filter element 62 is interrupted. At the same time, the electric motor 122 is energized effecting rotation of the eccentric 124 causing the rocker plate 98 and the associated plate pads 112 to rock about the pivot pins 108. This action caused the pads 112 to impact or strike the expanded metal screen 66 which in turn impacts the pleated paper core 64 and dislodges particulate contaminant collected on the surface thereof. The dislodged particulate contaminants fall downwardly and are collected in the dust chamber 46.

The resultant system can be seen to be extremely efficient and one in which the amount of down-time is minimal compared with the known prior art.

Once the debris chamber 42 and the dust chamber 46 become full of debris and dust, the hopper 24 may be dumped by energizing the pressure fluid actuated means 26 to cause the hopper 24 to be pivoted forwardly. At this point in the operation, it will be appreciated that the closure doors 128 and 130 are maintained in their normally open position permitting the dust collected in the dust chamber 46 to pass between the intermediate wall 38 and the dividing wall 40 and thence out of the hopper 24 through the hinged top 52 as it swings to an open position due to the pivoting action of the hopper 24.

In accordance with the provisions of the patent statutes, the principle and mode of operation of the invention have been explained and what is considered to represent its preferred embodiment has been illustrated and described. It should, however, be understood that the invention may be practiced otherwise as specifically illustrated and described without departing from the scope of the appended claims.

What is claimed is:

1. A sweeper hopper and filter assembly including:
   a) a main housing defining a hopper, said housing including a particulate contaminate inlet, a clear air outlet, means providing communication between the inlet and the outlet, and means for maintaining a decreased pressure at the outlet compared to the pressure at the inlet, and
   b) a filter assembly disposed within the means providing communication between the inlet and outlet of said housing, said filter assembly including a removable filter media for militating against the flow of particulate contaminates therethrough, the filter media having a first surface facing upstream toward the inlet of said housing and a second surface facing downstream toward the clean air outlet of said housing, and means to dislodge particulate contaminates from the filter media, said means to dislodge including frame means having a hingedly mounted peripheral framing element for holding said filter media surrounding the removable filter media and an air permeable member extending across the second surface of the filter media, and means for intermittently impacting the air permeable member.

2. The sweeper hopper and filter assembly defined in claim 1, wherein said means for intermittently impacting said air permeable member includes:
   a) a rocker mounting base fixedly mounted on said peripheral framing element,
   b) a rocker plate pivotally mounted to said rocker mounting base,
   c) rocker plate pads fastened to opposite sides of said rocker plate, and
   d) means to cause said rocker plate pads to strike directly said air permeable member.

3. The sweeper hopper and filter assembly defined in claim 2, wherein said means to cause said rocker plate pads to strike said air permeable member include:
   a) a mounting bracket mounted to said rocker plate,
   b) an electric motor mounted to said mounting bracket, and
   c) an eccentric weight affixed to the shaft of said motor to shake the motor and the rocker plate upon operation of the motor.

4. The sweeper housing and filter assembly defined in claim 3, wherein said rocker plate pads are vertically adjustable with respect to said rocker plate.

5. The sweeper hopper and filter assembly defined in claim 1, wherein a latch mechanism is provided on said rocker mounting base to keep said peripheral frame member firmly pressed against said air permeable member and to allow for the release of said peripheral frame member and its swinging about said hinge means when desired to permit the removal of said filter.

6. A filter shaker assembly including, in combination:

a) a hingedly mounted filter element frame, b) a rocker mounting base fixedly mounted on said filter element frame, c) a rocker plate pivotally mounted on said rocker mounting base, d) rocker plate pads fastened to opposite sides of a rocker plate, and e) means to cause said rocker plate pads to strike directly a filter mounted beneath said filter shaker assembly.

7. The filter shaker assembly defined in claim 6, wherein means to cause said rocker plate pads to strike said expanded metal screen include:

a) a mounting bracket mounted to said rocker plate, b) an electric motor mounted to said mounting bracket, c) an eccentric weight affixed to the shaft of said motor to shake the motor and the rocker plate upon operation of the motor.

8. The shaker filter assembly defined in claim 7, wherein said rocker plate pads are vertically adjustable with respect to said rocker plate.

9. The shaker filter assembly defined in claim 8, wherein said filter element frame is hingedly mounted to the interior of a sweeper hopper.

* * * * *